United States Patent [19]

Knox

[11] 4,372,704

[45] Feb. 8, 1983

[54] METHOD AND APPARATUS FOR GROUTING OF OFFSHORE PLATFORM PILINGS

[75] Inventor: Lloyd C. Knox, Duncan, Okla.

[73] Assignee: Halliburton Company, Duncan, Okla.

[21] Appl. No.: 2,919

[22] Filed: Jan. 12, 1979

Related U.S. Application Data

[63] Continuation of Ser. No. 818,174, Jul. 22, 1977, abandoned.

[51] Int. Cl.[3] ..... E02D 5/00; E02D 5/14

[52] U.S. Cl. ..... 405/225; 405/227

[58] Field of Search ..... 405/224-227, 405/195-208

[56] References Cited

U.S. PATENT DOCUMENTS

| | | | |
|---|---|---|---|
| 3,533,241 | 10/1970 | Bowerman et al. | 405/225 |
| 3,702,537 | 11/1972 | Landers | 405/225 X |
| 4,024,723 | 5/1977 | Mayfield et al. | 405/227 |
| 4,047,391 | 9/1977 | Mayfield et al. | 405/225 |
| 4,052,861 | 10/1977 | Malone et al. | 405/225 X |
| 4,063,427 | 12/1977 | Hoffman | 405/225 |
| 4,077,224 | 3/1978 | Coone | 405/225 |

*Primary Examiner*—Dennis L. Taylor

*Attorney, Agent, or Firm*—James R. Duzan

[57] ABSTRACT

An inflatable packer and method for sealing the annulus between an outer member and a pile driven therethrough. The inflatable packer comprises a packer housing, first and second guide rings secured within the packer housing, and an inflatable packer member having its ends secured from axial movement within the packer housing by the first and second guide rings. The method of sealing an annulus between an outer member and a pile driven therethrough comprises the steps of sealing the annulus at a first location, injecting gas into the annulus to expel any material contained within the annulus, sealing the annulus at a second location which is free of material, venting the annulus between the first location and second location while maintaining the annulus free of any material, and injecting grouting material into the annulus between the first location and second location.

18 Claims, 6 Drawing Figures

METHOD AND APPARATUS FOR GROUTING OF OFFSHORE PLATFORM PILINGS

This is a continuation of application Ser. No. 818,174, filed July 22, 1977 abandoned.

This invention relates to an inflatable seal and method for sealing the annulus between an outer hollow member and a pile driven therethrough, and more particularly relates to an inflatable grouting seal and method to support a column of grout in the annulus while the grout is setting, especially during the installation insitu of marine platforms of the type used by oil well drilling and producing companies.

The prior art teaches several seal structures and methods of this general type, adapted for use especially where the seal closes the annulus between a pile sleeve or platform leg and a pile driven therethrough, such as U.S. Pat. Nos. 3,468,132, 3,533,241, 3,570,259, 3,702,537, 3,878,687 and 4,024,723 which are incorporated herein by reference to the extent necessary. These prior art structures and methods when for use in deep water applications are generally expensive to manufacture and easily damaged or are only suitable for use in shallow water applications.

In contrast to the prior art structures and methods, the present invention comprises an inexpensive inflatable packer and method for sealing the annulus between an outer member and a pile driven therethrough for either deep water or shallow water applications.

BRIEF DESCRIPTION OF THE DRAWINGS

Referring to FIG. 1, an offshore platform 10 is shown having the inflatable packers 40 installed in the bottom of the platform jacket legs 11 while the inflatable packers 40′ are installed in the top of the platform jacket legs 11. A pile 20 is shown as being partially driven to depth with the pile extending out the top of the inflatable packer 40′ while another pile 20 is shown being driven to the desired depth.

In FIG. 2, an offshore platform 30 is shown having the inflatable packers 40 installed in the top and bottom of the pile sleeves 32 of the jacket legs 31. A pile 20 is shown as being driven to depth.

As shown in FIG. 3, the inflatable packer 40 comprises a packer housing 41, guide rings 42 and 43, an elastomeric packer member 44 and packer member back-up shoes 48 and 49. The packer housing 41 is cylindrical and made in any convenient diameter to match the jacket leg 11 to which it is welded as at 12 and 13.

Figure 1:
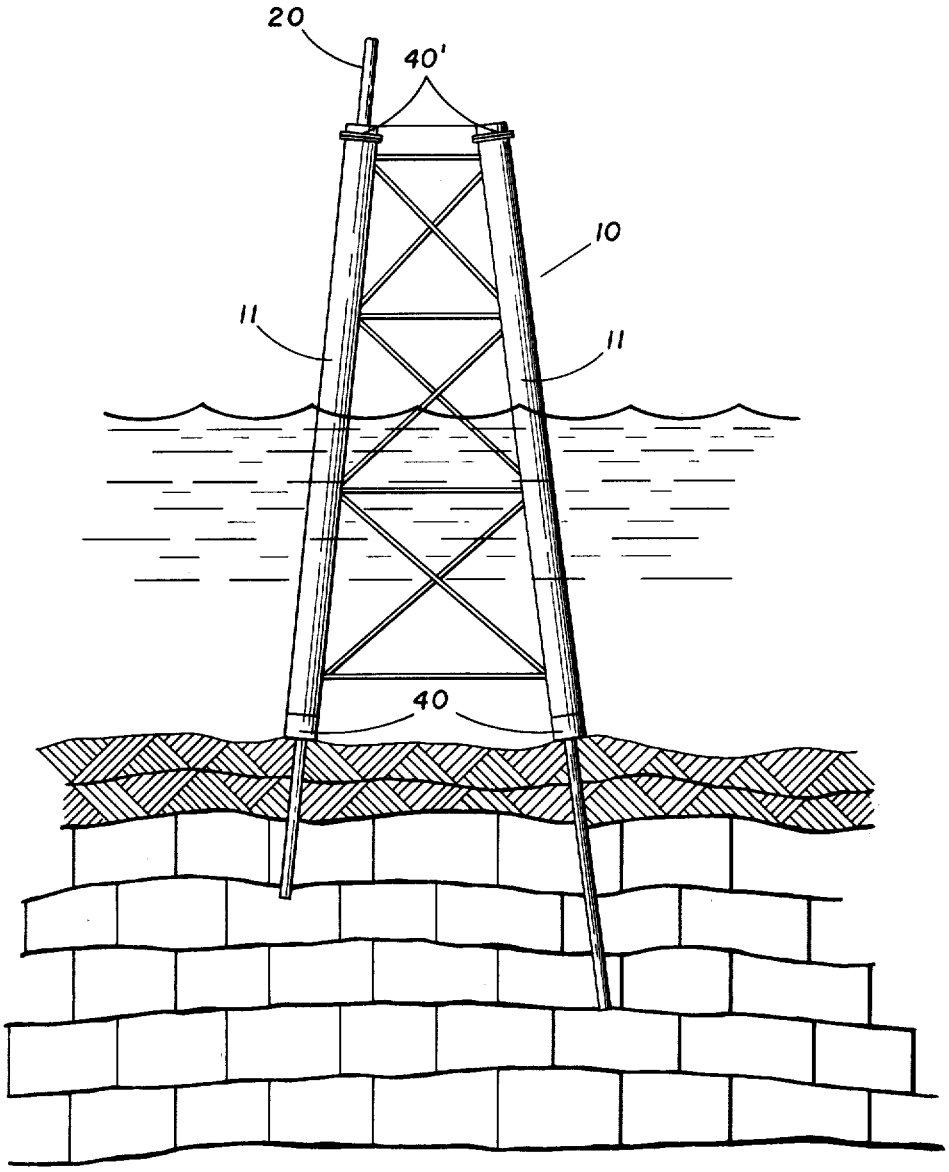
FIG. 1 shows the invention installed in the jacket legs of an offshore platform.

The guide ring 42 is welded to the packer housing 41 to secure one end of the packer member 44 within the packer housing 41 from any axial movement within the packer housing 41. The guide ring 42 is formed with a reduced thickness portion having two annular channels 52 and 53 which mate with the annular beads 58 and 59 respectively on one end of the packer member 44. The guide ring 42 further includes annular bead 56 which prevents the withdrawal of annular bead 59 of packer member 44 from annular channel 53.

Similarly, guide ring 43 is welded to the packer housing 41 to secure the other end of the packer member 44 within the packer housing 41 from any axial movement within the packer housing 41. The guide ring 43 is formed with a reduced thickness portion having two annular channels 54 and 55 which mate with annular beads 60 and 61 respectively on the other end of packer member 44. The guide ring 43 further includes annular bead 57 which prevents the withdrawal of annular bead 61 of packer member 44 from annular channel 55.

The packer member 44 can be formed of any suitable elastomeric material, although rubber is preferred. The packer member 44 has an annular reinforcing member 45 which is anchored about one end by an annular metal ring 46 contained in annular bead 59 located on one end of the packer member 44 while the other end of reinforcing member 45 is anchored about annular metal ring 47 contained in annular bead 61 located on the other end of the packer member 44. The reinforcing member 45 can be of any suitable material, although a fabric of nylon or Kevlar is preferred. The annular metal rings 46 and 47 may be either solid steel or twisted steel cable. The packer member 44 further comprises an annular band of material 50 located adjacent one end of the packer member 44 on the inner diameter thereof which underlies the fingers 62 of back-up shoe 48 while an annular band of material 51 located adjacent the other end of the packer member 44 on the inner diameter thereof underlies the fingers 63 of back-up shoe 49. The annular bands 50 and 51 of the material serve to protect the packer member 44 from damage by the fingers 62 and 63 of the back-up shoes 48 and 49 respectively when the packer element is being inflated and to prevent the flow of rubber into the slots 64 and 65 when the packer member 44 is being formed. The annular bands 50 and 51 may be formed of any suitable flexible material which has sufficient strength to protect packer member 44, such as steel, brass, etc., although a fabric of nylon or Kevlar is preferred.

The back-up shoe 48 is an annular metal band having fingers 62 separated by spaces 64 and is located on the inner diameter of the packer member 44 adjacent one end thereof. Similarly, the back-up shoe 49 is an annular metal band having fingers 63 separated by spaces 65 and is located on the inner diameter of the packer member 44 adjacent the other end thereof. The back-up shoes 48 and 49 may be formed of any suitable metal, although steel is preferred. The back-up shoes 48 and 49 initially protect the packer element 44 from being damaged by the pile 20 while the pile is being driven therethrough since the back-up shoes 48 and 49 hold the packer member 44 against the packer housing 41 until the packer member 44 is inflated.

Figure 4:
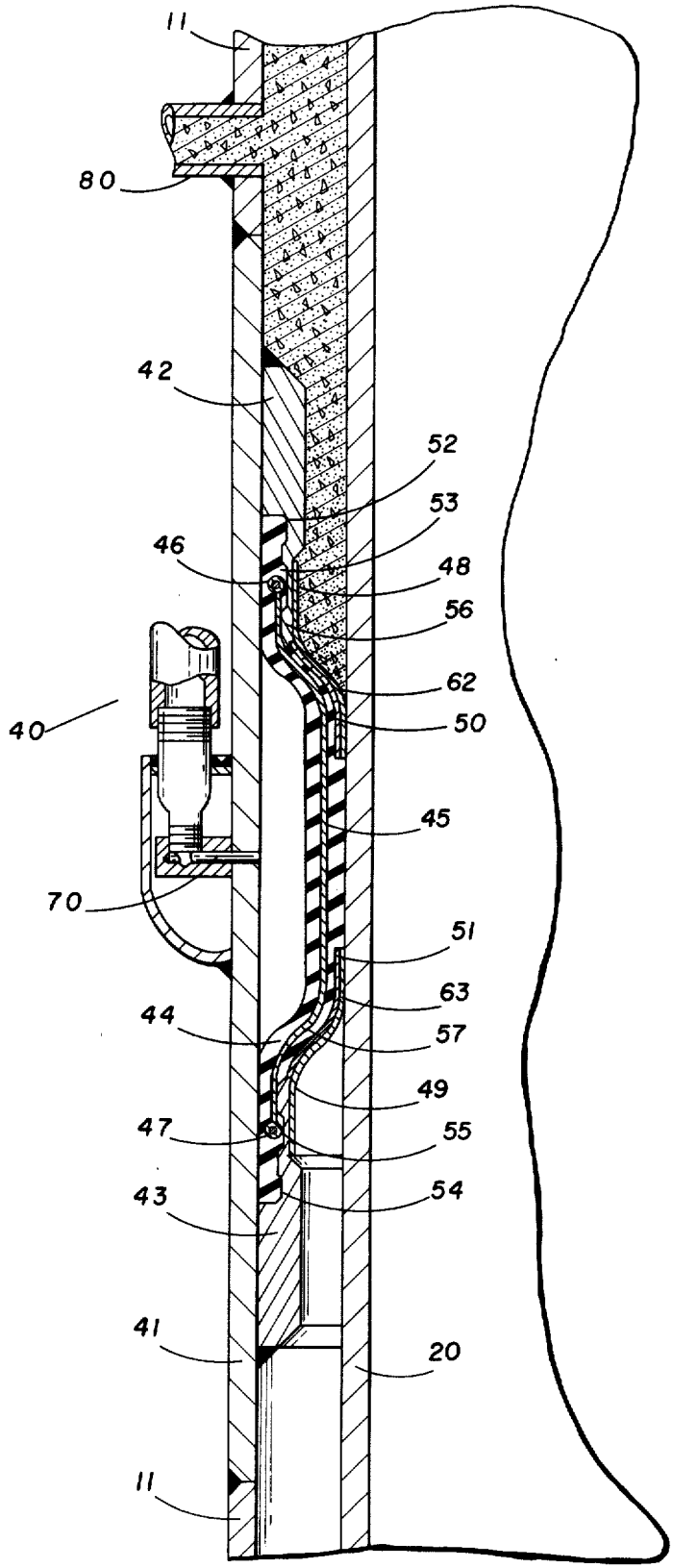
FIG. 4 shows the invention in partial cross-section installed in a jacket leg or pile sleeve in an inflated position with grout filling the annulus between the pile and the jacket leg.

Referring to FIG. 4, the inflatable packer 40 is shown in its inflated position. The packer member 44 is inflated to firmly grip the pile 20, which has been driven to the desired depth, by pumping any suitable fluid or gas under pressure through the packer inflation port 70. As shown, when the packer member 44 is inflated, the back-up shoes 48 and 49 are deflected inwardly until the fingers 62 and 63 are seated on the pile 20. When the packer member 44 is in its inflated position, the back-up shoes 48 and 49 lend axial support to the packer member 44 and prevent axial extrusion and subsequent damage of the packer member 44 over annular beads 56 and 57 of guide rings 42 and 43 respectively. As further shown, when the packer member 44 is inflated, the ends of the packer member 44 are secured from axial movement by means of annular rings 46 and 47. The annular metal rings 46 and 47 prevent the ends of packer member 44 from being forced from the annular channels 52 and 53 of the guide ring 42 and annular channels 54 and 55 of guide ring 43 respectively since the annular metal rings 46 and 47 prevent the compression of the ends of the packer member 44 to a degree which would allow the ends of the packer member 44 to pass between the annular beads 56 and 57 and the packer housing 41.

The ends of the packer member 44 may be secured against axial movement within the packer housing 41 by the guide rings 42 and 43 since the inflation of the packer member 44 occurs inwardly thereby effectively compressing the packer member 44.

After the packer member 44 has been inflated, grouting material is pumped through the grouting line 80 into the annulus between the pile 20 and the platform jacket leg 11 above the packer 40 with the packer supporting the weight of the grouting in the annulus while preventing the grouting from leaking into the annulus below the packer 40 or the surrounding environment from leaking into the annulus above the packer 40 and contaiminating the grouting material.

Figure 5:
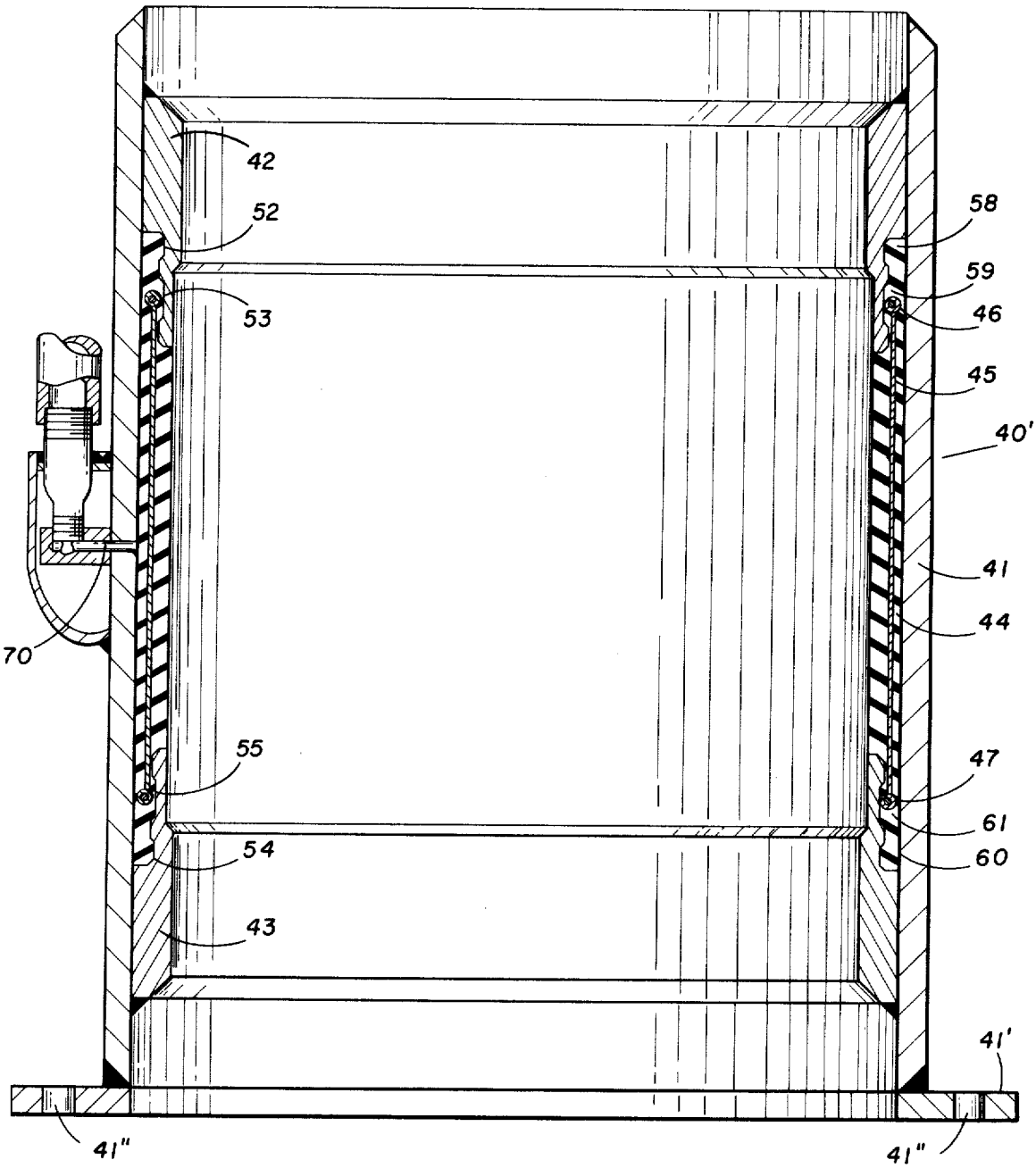
FIG. 5 is a modified embodiment of the invention for use as the top packer in a jacket leg.

Referring to FIG. 5, a modified inflatable packer 40' is shown. The inflatable packer 40' is designed for use as the top packer in the platform jacket legs 11 during a grouting operation. The inflatable packer 40' is identical to the packer 40 described hereinbefore, except it does not have back-up shoes and annular bands of material underlying the back-up shoes for the packer member 44 and it has a flange 41' located on one end of the packer housing 41.

Since the packer 40' is used as a temporary seal on the top of the platform jacket legs 11 during a grouting operation, no large axial forces due to the weight of the grouting material act upon the packer member 44. Therefore, it is undesirable to have the back-up shoes in the packer 40' since once the packer has been inflated, they would remain in engagement with the pile and prevent removal of the packer 40' from the platform jacket leg after the grouting operation is completed. The flange 41' on one end of packer housing is formed with a series of holes 41'' through which threaded fasteners may be inserted to secure the packer 40' to the top of jacket leg 11. Although the use of a flange and threaded fasteners is the preferred means for temporarily securing the packer 40' to the top of jacket leg 11, any suitable attachment means may be used, such as welding.

Although annular bands of material have not been shown which would underlie the back-up shoes since the packer 40' does not require back-up shoes, the packer element 44 could be formed with the annular bands if so desired.

Figure 6:
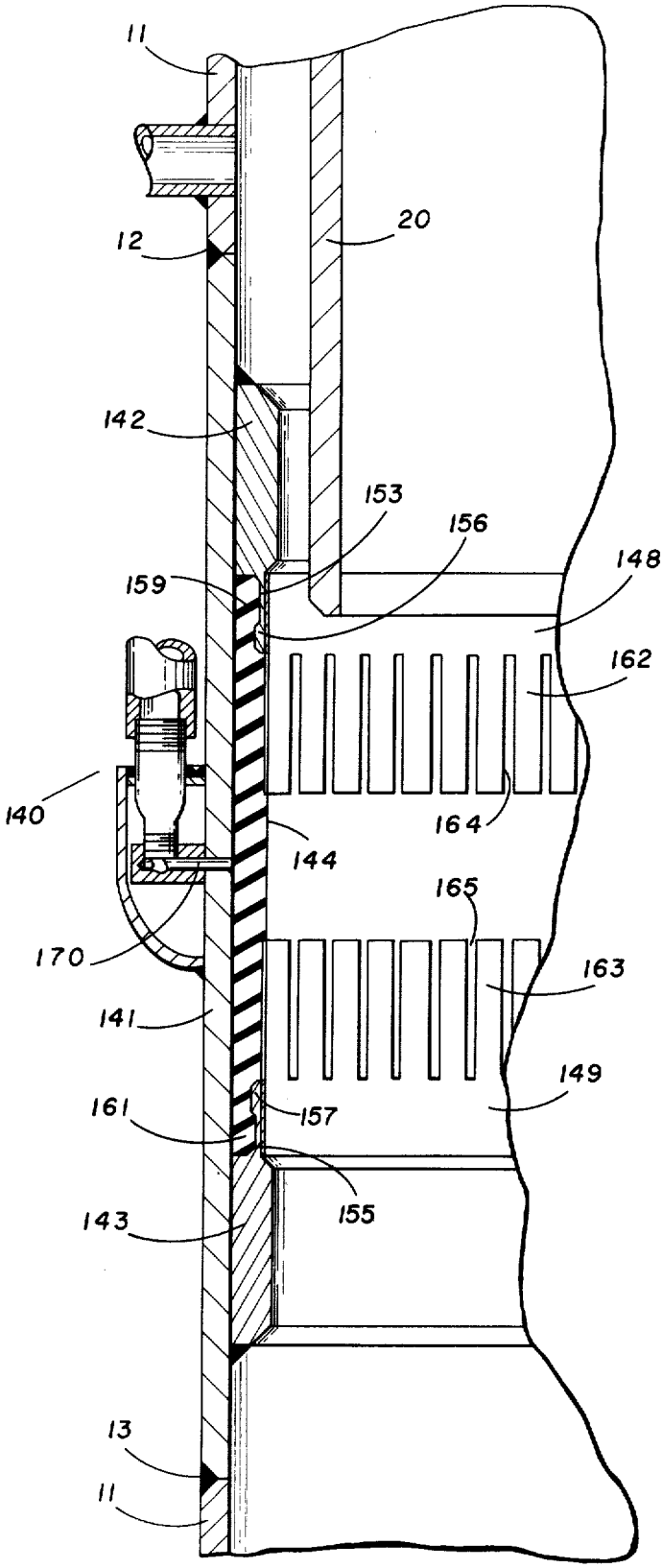
FIG. 6 shows the invention in partial cross-section installed in a jacket leg or pile sleeve in an uninflated position having a modified packer element and packer element attachment means.

Referring to FIG. 6, an inflatable packer 140 having modified packer member 144 and packer member attachment means is shown. The inflatable packer 140 comprises a packer housing 141, guide rings 142 and 143, an elastomeric packer member 144 and packer member back-up shoes 148 and 149. The packer housing 141 is cylindrical and made in any convenient diameter to match the jacket leg 11 to which it is welded as at 12 and 13.

The guide ring 142 is welded to the packer housing 141 to secure one end of the packer member 144 within the packer housing 141 from any axial movement within the packer housing 141. The guide ring 142 is formed with a reduced thickness portion having an annular channel 153 which mates with annular bead 159 on one end of the packer member 144. The guide ring 142 further includes annular bead 156 which prevents the withdrawal of annular bead 159 of packer member 144 from annular channel 153.

Similarly, guide ring 143 is welded to the packer housing 141 to secure the other end of the packer member 144 within the packer housing 141 from any axial movement within the packer housing 141. The guide ring 143 is formed with a reduced thickness portion having an annular channel 155 which mates with annular bead 161 on the other end of packer member 144. The guide ring 143 further includes annular bead 157 which prevents the withdrawal of annular bead 161 of packer member 144 from annular channel 155.

The packer member 144 can be formed of any suitable elastomeric material having sufficient strength, although rubber is preferred. The packer member 144, although shown having annular beads 159 and 161 which mate with channels 153 and 155 in guide rings 142 and 143 respectively securing the ends of the packer member 144 against axial movement within the packer housing 141, may be formed with any suitable securing means, such as multiple packer member annular beads, collar type securing means, etc. The annular beads 159 and 161 are merely illustrative of suitable securing means. Similarly, the packer member 144 may be formed of any suitable elastomeric material or any suitable reinforced elastomeric material, depending upon the desired packer element strength.

A back-up shoe 148 formed of an annular metal band having fingers 162 separated by spaces 164 is located adjacent one end of the packer member 144 on the inner diameter thereof. Similarly, a back-up shoe 149 formed of an annular metal band having fingers 163 separated by spaces 165 is located adjacent the other end of the packer member 144 on the inner diameter thereof. The back-up shoes 148 and 149 may be formed of any suitable metal, although steel is preferred. The back-up shoes 148 and 149 initially protect the packer element 144 from being damaged by the pile 20 while the pile is being driven therethrough since the back-up shoes 148 and 149 hold the packer member 144 against the packer housing 141 until the packer member 144 is inflated. After the packer 140 is inflated, the back-up shoes 148 and 149 lend axial support to the packer member 144 to support the weight of grouting material in the annulus between the pile and the jacket leg or pile sleeve.

Although not shown, when the inflatable packer 140 is inflated, it assumes an inflated shape identical with inflatable packer 40 described hereinbefore.

Again referring to FIG. 1, the inflatable packers 40 and 40' are shown installed on the lower ends and the top ends respectively of platform jacket legs 11. As shown, the packers 40 are welded to the bottoms of jacket legs 11 while the packers 40' are secured by means of suitable threaded fasteners to the tops of jacket legs 11. Although not shown in the drawing, inflation lines run to the inflation ports 70 of each packer 40 and 40' while grouting lines typically run to the jacket legs 11 immediately below the packers 40'.

To grout the annulus between the piles 20 and the jacket legs 11 after the piles have been driven to depth, the packers 40' on the tops of platform jacket legs 11 are inflated to seal the annuli between the piles and the jacket legs. Air or any other suitable gas is then injected through the grout lines to evacuate the annuli between the piles and jacket legs by forcing the water in the annuli out the bottoms of the jacket legs past the packers 40. When the annuli are evacuated, the packers 40 are inflated to seal the annuli at the bottom of the jacket legs. The air pressure within the annuli is then released to substantially atmospheric pressure, although the air pressure may be released to any desired pressure level, and the packers 40' may be removed from the tops of the jacket legs 11 if so desired. At this time, grout is pumped through the grouting lines into the annuli and falls to the bottom of the annuli until the annuli are completely filled. If the packers 40' have not been removed, they are removed for future use at this time.

If the platform 10 has grouting lines running to the bottoms of the annuli between the piles 20 and the jacket legs 11 rather than the tops of the annuli, the method of grouting remains unchanged.

By using a packer at both the top and bottom of the jacket legs 11 on the platform 10, an improved grouting method results because it is not necessary to maintain the annuli in the jacket legs under pressure until the grout hardens to insure the water surrounding the jacket legs does not dilute the grouting material, it can be readily ascertained whether or not the annuli are free of water to insure no dilution of the grouting material and it is not necessary to pump large quantities of grouting material into the silt on the ocean floor surrounding the jacket legs to insure that the annuli in the jacket legs have been filled with grouting material.

Figure 2:
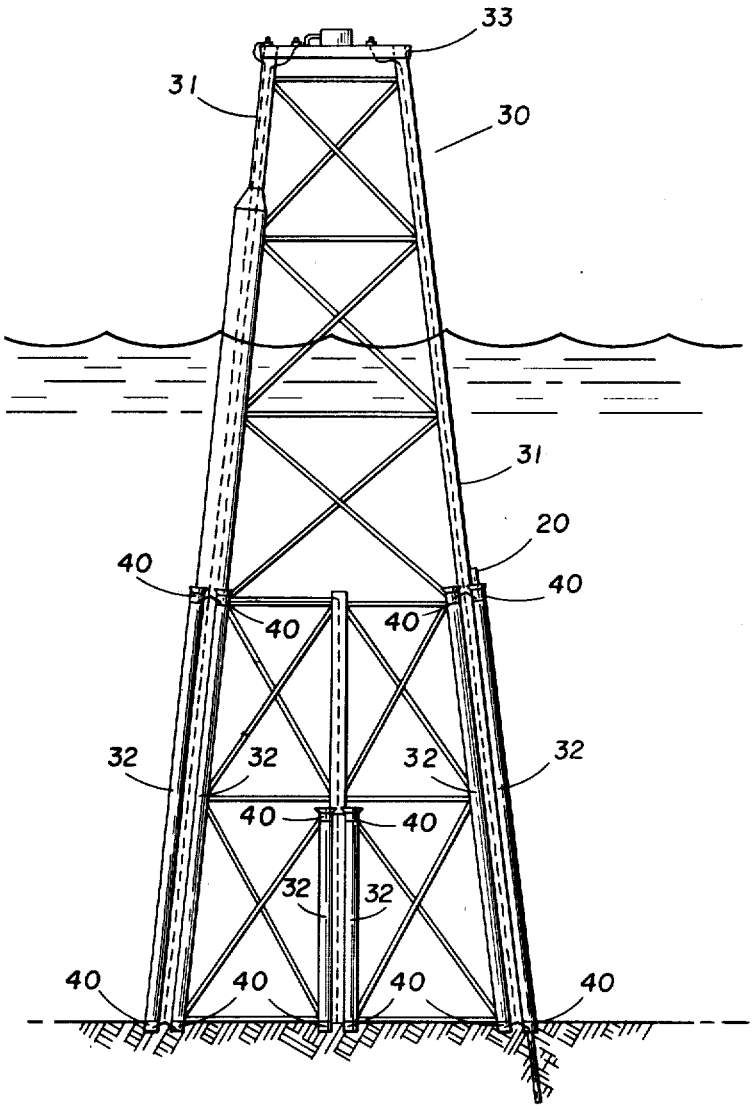
FIG. 2 shows the invention installed in the pile sleeves of the jacket legs of an offshore platform.
Figure 3:
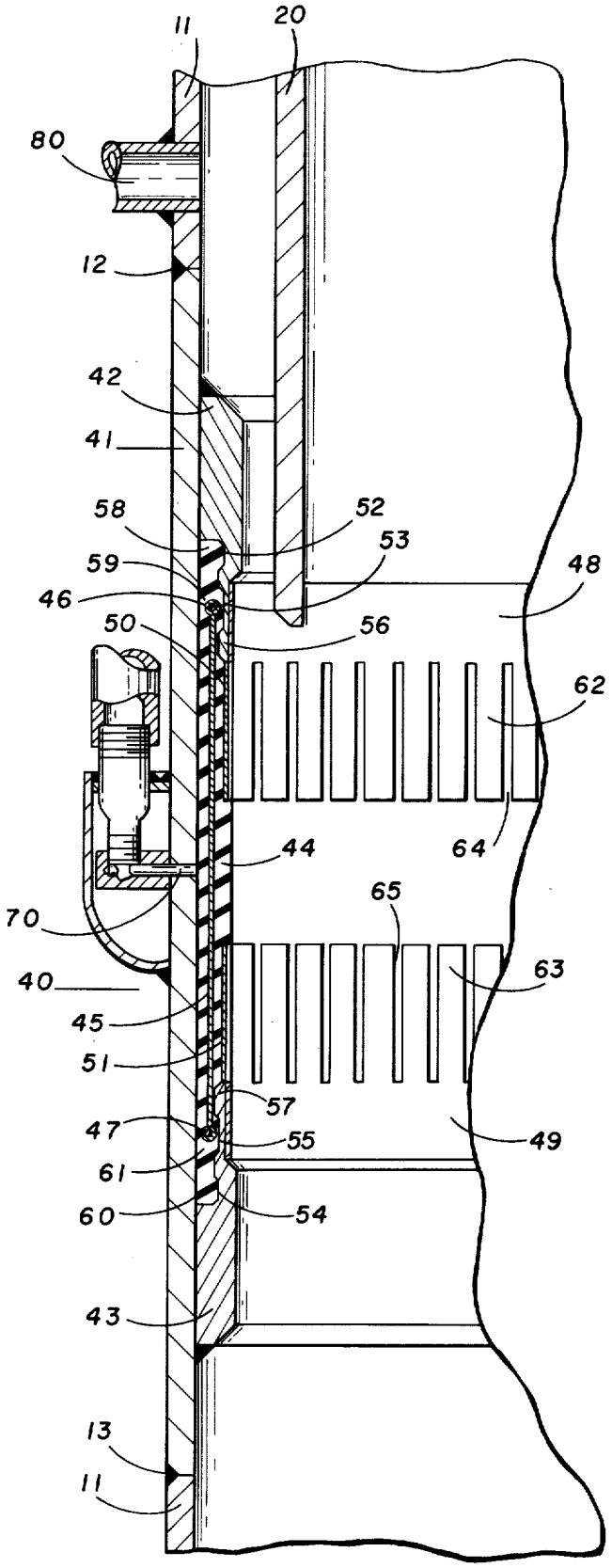
FIG. 3 shows the invention in partial cross-section installed in a jacket leg or pile sleeve in an uninflated position.

Referring to FIG. 2, the platform 30 is shown having packers 40 installed in the tops and bottoms of pile sleeves 32 of platform jacket legs 31 and the pile sleeves 32 intermediate the jacket legs 31. Although the packer inflation lines are shown in phantom in FIG. 2, the pile sleeve grouting lines which are typically installed in the annuli adjacent the bottom packers 40 in the pile sleeves 32 and the pile sleeve vent lines which are typically installed adjacent the top packers 40 in the pile sleeves 32 are not shown. After the piles 20 are driven to the desired depths, the packers 40 in the tops of the pile sleeves 32 are inflated to seal the annuli between the piles 20 and the pile sleeves 32. The annuli are then evacuated by injecting air or any suitable gas into the vent lines to force the water in the annuli out the bottoms of the pile sleeves 32 past the packers 40. Subsequently, the packers 40 in the bottoms of pile sleeves 32 are inflated to seal the bottoms of the annuli from the surrounding environment. The air pressure in the annuli is then released to any desired pressure level, although atmospheric pressure is the normal venting pressure and grouting is pumped through the grouting lines adjacent the bottom packers 40 in the pile sleeves 32 until the grouting flows out the vent lines at the surface 33 of the platform 30. If an amount of water remained in the annuli and diluted the grouting material being pumped into the annuli, grouting can be pumped into the annuli until such time as the grouting flowing out the vent lines at the platform surface 33 is the same quality as the grouting being pumped into the annuli.

By using a packer at both the top and bottom of the pile sleeves 32 on the platform 30, an improved grouting method results because it is not necessary to maintain the annuli in the pile sleeves under pressure until the grout hardens to insure the water surrounding the pile sleeves does not dilute the grouting material, it can be readily ascertained whether or not the annuli are free of water to insure no dilution of the grouting material and it is not necessary to pump large quantities of grouting material into the silt on the ocean floor surrounding the jacket legs to insure that the annuli in the jacket legs have been filled with grouting material.

Although the inflatable packers have been described for use in platform jacket leg and pile sleeve grouting operations, the inflatable packers may be used in any situation where a seal is desired between two members such as concentric pipes, a pipe and a wall, etc. Although the inflatable packers described herein have been shown with specific packer member securing means, any suitable securing means which is capable of securing the packer member against axial movement within the packer housing may be used. Similarly, depending upon the desired packer member strength, the packer member may be formed of any suitable elastomeric material and may either be reinforced by any suitable reinforcing means or be constructed solely of elastomeric material.

The invention described herein regarding the inflatable packers and the methods of grouting the jacket legs or pile sleeves of offshore platforms is declared to cover all changes and modifications of the specific examples of the invention herein disclosed for purposes of illustration, which do not constitute departures from the spirit and scope of the invention.

What is claimed is:

1. An inflatable packer for use in the sealing of an annulus formed by a jacket leg and/or pile sleeve of a marine platform having a pile inserted therethrough prior to the grouting of said annulus, or the like, said inflatable packer comprising:

an annular packer housing secured to said jacket leg, said pile sleeve, or the like;

a first guide ring secured within said annular packer housing having a portion extending therefrom;

a second guide ring secured within said packer housing having a portion extending therefrom;

an annular inflatable packer member having a first end portion, intermediate portion, a second end portion and having reinforcing means therein, the first end portion being secured from axial movement within said packer housing by being secured to the portion extending from said first guide ring while the second end portion of said inflatable packer member is secured from axial movement within said packer housing by being secured to the portion extending from said second guide ring;

a first back-up shoe secured to said first guide ring adjacent the first end portion of said inflatable packer member being located on the interior thereof, said first back-up shoe comprising:

a unitary annular band having a plurality of fingers extending therefrom, each finger of the plurality of fingers being separated from an adjacent finger thereby forming a space between each adjacent finger of the plurality of fingers whereby said first back-up shoe overlays the first end portion of said inflatable packer member thereby preventing the first end portion of said inflatable packer member from extending into said annulus before the inflation of said inflatable packer to prevent said pile from damaging said inflatable packer member during the insertion of said pile therethrough; and a second back-up shoe secured to said second guide ring adjacent the second end portion of said inflatable packer member being located on the interior thereof, said second back-up shoe comprising:

a unitary annular band having a plurality of fingers extending therefrom, each finger of the plurality of fingers being separated from an adjacent finger thereby forming a space between each adjacent finger of the plurality of fingers whereby said second back-up shoe overlays the second said portion of said inflatable packer member thereby preventing the second end portion of said inflatable packer member from extending into said annulus before the inflation of said inflatable packer to prevent said pile from damaging said inflatable packer member during the insertion of said pile therethrough whereby when said inflatable packer member is inflated to seal said annulus, said inflatable packer member is inflated inwardly so that the intermediate portion thereof firmly engages said pile to seal said annulus while said first back-up shoe and said second back-up shoe have the plurality of fingers thereof deflected inwardly until seated on said pile thereby lending axial support to said inflatable packer member and preventing axial extrusion of the first end portion and second end portion of said inflatable packer member over said first end ring and said second end ring respectively during the inflation of said inflatable packer member and the grouting of said annulus.

2. The inflatable packer of claim 1 wherein:

said first guide ring secured within said packer housing having a reduced thickness portion comprising a first annular channel, a second annular channel, and an annular bead, the reduced thickness portion of said first guide ring mating with the one end of said inflatable packer member to secure the one end of said inflatable packer member from axial movement within said packer housing; and said second guide ring secured within said packer housing having a reduced thickness portion comprising a first annular channel, a second annular channel, and an annular bead, the reduced thickness portion of said second guide ring mating with the other end of said inflatable packer member to secure the other end of said inflatable packer member from axial movement within said packer housing.

3. The inflatable packer of claim 1 wherein said inflatable packer member comprises an annular elastomeric member having a metal ring contained in one end of the annular elastomeric member, a metal ring contained in the other end of the annular elastomeric member, and an annular reinforcing member having one end secured by the metal ring in the one end of the annular elastomeric member with the other end of the annular reinforcing member secured by the metal ring in the other end of the annular elastomeric member.

4. The inflatable packer of claim 3 wherein said inflatable packer member further comprises an annular band of material adjacent the one end of the annular elastomeric member located on the interior surface of the annular elastomeric member and an annular band of material adjacent the other end of the annular elastomeric member located on the interior surface of the annular elastomeric member.

5. The inflatable packer of claim 2 wherein the inflatable packer member comprises an annular elastomeric member having a first annular bead and a second annular bead located on one end of the annular elastomeric member, a first annular bead and a second annular bead located on the other end of the annular elastomeric member, a metal ring contained within the second annular bead on the one end of the annular elastomeric member, a metal ring contained within the second annular bead on the other end of the annular elastomeric member, and an annular reinforcing member having one end secured by the metal ring contained within the second annular bead on the one end of the annular elastomeric member with the other end of the annular reinforcing member secured by the metal ring contained within the second annular bead on the other end of the annular elastomeric member whereby the first annular bead and the second annular bead located on one end of the annular elastomeric member mate with the first annular channel and the second annular channel respectively in the reduced thickness portion of said first guide ring while the first annular bead and second annular bead located on the other end of the annular elastomeric member mate with the first annular channel and the second annular channel respectively in the reduced thickness portion of said second guide ring thereby securing the annular elastomeric member from axial movement within said packer housing.

6. The inflatable packer of claim 5 wherein said inflatable packer member further comprises an annular band of material adjacent the one end of the annular elastomeric member located on the interior surface of the annular elastomeric member and an annular band of material adjacent the other end of the annular elastomeric member located on the interior surface of the annular elastomeric member.

7. The inflatable packer of claim 1 wherein:

said first guide ring secured within said packer housing having a reduced thickness portion comprising a first annular channel, a second annular channel and an annular bead, the reduced thickness portion of said first guide ring mating with the one end of said inflatable packer member to secure the one end of inflatable packer member from axial movement within said packer housing; and said second guide ring secured within said packer housing having a reduced thickness portion comprising a first annular channel, a second annular channel, and an annular bead, the reduced thickness portion of said second guide ring mating with the other end of said inflatable packer member to secure the other end of said inflatable packer member from axial movement within said packer housing.

8. The inflatable packer of claim 7 wherein the inflatable packer member comprises an annular elastomeric member having a first annular bead and a second annular bead located on one end of the annular elastomeric member, a first annular bead and a second annular bead located on the other end of the annular elastomeric member, a metal ring contained within the second annular bead on the one end of the annular elastomeric member, a metal ring contained within the second annular bead on the other end of the annular elastomeric member, and an annular reinforcing member having one end secured by the metal ring contained within the second annular bead on the one end of the annular elastomeric member with the other end of the annular reinforcing member secured by the metal ring contained within the second annular bead on the other end of the annular elastomeric member whereby the first annular bead and the second annular bead located on one end of the annular elas'omeric member mate with the first annular channel and the second annular channel respectively in the reduced thickness portion of said first guide ring while the first annular bead and second annular bead located on the other end of the annular elastomeric member mate with the first annular channel and the second annular channel respectively in the reduced thickness portion of said second guide ring thereby securing the annular elastomeric member from axial movement within said packer housing.

9. The inflatable packer of claim 8 wherein said inflatable packer member further comprises an annular band of material adjacent the one end of the annular elastomeric member located on the interior surface of the annular elastomeric member and an annular band of material adjacent the other end of the annular elastomeric member located on the interior surface of the annular elastomeric member.

10. The inflatable packer of claim 5 wherein said packer housing has a flange located at one end thereof.

11. The inflatable packer of claim 6 wherein said packer housing has a flange located at one end thereof.

12. The inflatable packer of claim 1 wherein:

said first guide ring secured within said packer housing having a reduced thickness portion comprising an annular channel and an annular bead, the reduced thickness portion of said first guide ring mating with the one end of said inflatable packer member to secure the one end of said inflatable packer member from axial movement within said packer housing; and said second guide ring secured within said packer housing having a reduced thickness portion comprising an annular channel and an annular bead, the reduced thickness portion of said second guide ring mating with the other end of said inflatable packer member to secure the other end of said inflatable packer member from axial movement within said packer housing.

13. The inflatable packer of claim 12 wherein the inflatable packer member comprises an annular elastomeric member having an annular bead located on one end of the annular elastomeric member and an annular bead located on the other end of the annular elastomeric member whereby the annular bead located on one end of the annular elastomeric member mates with the annular channel in the reduced thickness portion of said first guide ring while the annular bead located on the other end of the annular elastomeric member mates with the annular channel in the reduced thickness portion of said second guide ring thereby securing the annular elastomeric member from axial movement within said packer housing.

14. An inflatable packer comprising:

a packer housing;

a first guide ring secured within said packer housing having a reduced thickness portion comprising a first annular channel, a second annular channel, and an annular bead;

a second guide ring secured within said packer housing having a reduced thickness portion comprising a first annular channel, a second annular channel and an annular bead;

an inflatable packer member comprising an annular elastomeric member having a first annular bead and a second annular bead located on one end of the annular elastomeric member, a first annular bead and a second annular bead located on the other end of the annular elastomeric member, a metal ring contained within the second annular bead on the one end of the annular elastomeric member, an annular band of material adjacent the one end of the annular elastomeric member located on the interior surface of the annular elastomeric member, an annular band of material adjacent the other end of the annular elastomeric member located on the interior surface of the annular elastomeric member, a metal ring contained within the second annular bead on the other end of the annular elastomeric member, and an annular reinforcing member having one end secured by the metal ring contained within the second annular bead on the one end of the annular elastomeric member with the other end of the annular reinforcing member secured by the metal ring contained within the second annular bead on the other end of the annular elastomeric member whereby the first annular bead and the second annular bead located on one end of the annular elastomeric member mate with the first annular channel and the second annular channel respectively in the reduced thickness portion of said first guide ring while the first annular bead and second annular bead located on the other end of the annular elastomeric member mate with the first annular channel and the second annular channel respectively in the reduced thickness portion of said second guide ring thereby securing the annular elastomeric member from axial movement within said packer housing;

a first back-up shoe adjacent the one end of said inflatable packer member; and a second back-up shoe adjacent the other end of said inflatable packer member.

15. An inflatable packer comprising:

a packer housing;

a first guide ring secured within said packer housing having a reduced thickness portion comprising a first annular channel, a second annular channel, and an annular bead;

a second guide ring secured within said packer housing having a reduced thickness portion comprising a first annular channel, a second annular channel and an annular bead; and an inflatable packer member having one end secured from axial movement within said packer housing by said first guide ring while the other end of said inflatable packer member is secured from axial movement within said packer housing by said second guide ring wherein said inflatable packer member comprises:

an annular elastomeric member having a first annular bead and a second annular bead located on one end of the annular elastomeric member, a first annular bead and a second annular bead located on the other end of the annular elastomeric member, a metal ring contained within the second annular bead on the one end of the annular elastomeric member, a metal ring contained within the second annular bead on the other end of the annular elastomeric member, and an annular reinforcing member having one end secured by the metal ring contained within the second annular bead on the one end of the annular elastomeric member with the other end of the annular reinforcing member secured by the metal ring contained within the second annular bead on the other end of the annular elastomeric member whereby the first annular bead and the second annular bead located on one end of the annular elastomeric member mate with the first annular channel and the second annular channel respectively in the reduced thickness portion of said first guide ring while the first annular bead and second annular bead located on the other end of the annular elastomeric member mate with the first annular channel and the second annular channel respectively in the reduced thickness portion of said second guide ring thereby securing the annular elastomeric member from axial movement within said packer housing.

16. The inflatable packer of claim 15 wherein said inflatable packer member further comprises an annular band of material adjacent the one end of the annular elastomeric member located on the interior surface of the annular elastomeric member and an annular band of material adjacent the other end of the annular elastomeric member located on the interior surface of the annular elastomeric member.

17. An inflatable packer comprising:

a packer housing;

a first guide ring secured within said packer housing having a reduced thickness portion comprising a first annular channel, a second annular channel, and an annular bead;

a second guide ring secured within said packer housing having a reduced thickness portion comprising a first annular channel, a second annular channel and an annular bead;

an inflatable packer member having one end secured from axial movement within said packer housing by said first guide ring while the other end of said inflatable packer member is secured from axial movement within said packer housing by said second guide ring, wherein the inflatable packer member comprises an annular elastomeric member having a first annular bead and a second annular bead located on one end of the annular elastomeric member, a first annular bead and a second annular bead located on the other end of the annular elastomeric member, a metal ring contained within the second annular bead on the one end of the annular elastomeric member, a metal ring contained within the second annular bead on the other end of the annular elastomeric member, and an annular reinforcing member having one end secured by the metal ring contained within the second annular bead on the one end of the annular elastomeric member with the other end of the annular reinforcing member secured by the metal ring contained within the second annular bead on the other end of the annular elastomeric member whereby the first annular bead and the second annular bead located on one end of the annular elastomeric member mate with the first annular channel and the second annular channel respectively in the reduced thickness portion of said first guide ring while the first annular bead and second annular bead located on the other end of the annular elastomeric member mate with the first annular channel and the second annular channel respectively in the reduced thickness portion of said second guide ring thereby securing the annular elastomeric member from axial movement within said packer housing;

a first back-up shoe adjacent the one end of said inflatable packer member; and a second back-up shoe adjacent the other end of said inflatable packer member.

18. The inflatable packer of claim 17 wherein said inflatable packer member further comprises an annular band of material adjacent the one end of the annular elastomeric member located on the interior surface of the annular elastomeric member and an annular band of material adjacent the other end of the annular elastomeric member located on the interior surface of the annular elastomeric member.

* * * * *